US005636519A

United States Patent [19]

Heilman

[11] Patent Number: 5,636,519

[45] Date of Patent: Jun. 10, 1997

[54] FLUID COMMINGLING CHAMBER FOR NITROGEN PROCESSING UNIT

[75] Inventor: Paul W. Heilman, Duncan, Okla.

[73] Assignee: Halliburton Company, Duncan, Okla.

[21] Appl. No.: 665,159

[22] Filed: Jun. 14, 1996

[51] Int. Cl.[6] ..... F17C 9/02

[52] U.S. Cl. ..... 62/50.2; 62/50.5

[58] Field of Search ..... 62/50.2, 50.5

[56] References Cited

U.S. PATENT DOCUMENTS

| | | | |
|---|---|---|---|
| 3,296,809 | 1/1967 | Feuerstein | 62/50.5 |
| 3,648,472 | 3/1972 | Kozlowski | 62/50.5 |
| 3,934,987 | 1/1976 | Bivins, Jr. | 62/50.2 |
| 3,949,565 | 4/1976 | Roop | 62/50.2 |
| 3,978,681 | 9/1976 | Kjelgaard et al. | 62/50.5 |
| 4,395,976 | 8/1983 | de Lallee et al. | 62/50.2 |
| 5,163,303 | 11/1992 | Miyata et al. | 62/50.2 |

*Primary Examiner*—Ronald C. Capossela
*Attorney, Agent, or Firm*—Stephen R. Christian

[57] ABSTRACT

An improved commingling chamber for the distribution and pressure equalization of a thermodynamic working fluid used in a recirculating liquid type heat transfer processing system. The improved commingling chamber includes a volumetric chamber generally defined by a vessel wall, a top portion of the chamber, a lower portion of the chamber having a side wall. The lower portion terminates into a base preferably having an outlet port located therein. At least one inlet port and outlet port are located in the vessel wall. A conduit having a first end attached to at least one inlet port and being of sufficient length and configuration to vector incoming fluid toward the base outlet port, and a flow through region between a terminating end of the conduit means is provided to form a flow path between fluid exiting the conduit and the volumetric chamber. Alternative embodiments for accommodating multiple inlet ports and outlet ports are disclosed.

20 Claims, 5 Drawing Sheets

FLUID COMMINGLING CHAMBER FOR NITROGEN PROCESSING UNIT

BACKGROUND

This invention pertains to nitrogen processing equipment typically used in the industry of well completion, well treatment, and enhancing the production of oil and gas from wells. More particularly, this invention pertains to flameless nitrogen processing units that use heat generated by internal combustion engines to vaporize liquid nitrogen by way of a common thermodynamic working fluid that is routed through a fluid commingling chamber of a recirculative heat exchange system.

Nitrogen processing units, often referred to within the industry as nitrogen converters, pump and convert low pressure liquid nitrogen into a high pressure liquid and/or gaseous nitrogen that is then used in a variety of operations and procedures used to induce and enhance the production of oil and gas from a wellbore. Nitrogen converters which do not use a direct flame to convert the liquid nitrogen are referred to as being "flameless" converters. Flameless type converters may be required or preferred in certain operating environments whether the well be located on land or offshore. Depending on the environment and the needed capacity, such units are truck body mounted, tractor trailer mounted, or skid mounted. Flameless type nitrogen converter units typically use waste heat from internal combustion engines that are needed to provide power to drive pumps used to transfer liquid nitrogen from storage tanks, or from engines that drive hydraulic systems that are used for operating related equipment, or from engines that are placed under a load in order to be a source of waste heat.

It is known within the art that converting low pressure liquid nitrogen into high pressure liquid/gaseous nitrogen can be achieved by readily using heat energy absorbed and transferred by an engine coolant, such as a liquid having anti-freezing characteristics. Such a liquid coolant is typically a mixture of ethylene glycol and water, or a functional equivalent thereof. The liquid coolant is circulated through cooling jackets of an engine usually by engine driven pumps. The then heated coolant is then routed to a commingling chamber of a predetermined volume, typically fabricated from a low carbon content steel or other suitable material used for forming low pressure vessels. The coolant still being at an elevated temperature, is then pumped out of the commingling chamber with the assistance of a separate auxiliary coolant pump to a heat exchanger referred to as a water bath vaporizer in which liquid nitrogen is being passed therethrough. Upon the liquid nitrogen receiving the heat energy previously stored in the heated engine coolant, the liquid nitrogen is vaporized, or more technically correct, converted as the nitrogen may be in either gas or liquid form, and is subsequently pumped and routed downhole or elsewhere for use in whatever operation is to be conducted at the job site. The now relatively cooler engine coolant may now be routed to a heat exchanger or a plurality of heat exchangers, that serve to cool transmission fluid for example, or hydraulic fluid, or it may be returned directly to the commingling chamber by the auxiliary coolant pump. A bypass valve may be installed wherein the coolant circulates only through the auxiliary pump, the nitrogen converter, and for example a transmission fluid heat exchanger and a hydraulic fluid heat exchanger, without being returned to the commingling chamber if so desired. Eventually, the coolant fluid is reintroduced to the commingling chamber wherein it is subsequently routed to the cooling radiator of the engine, or at some other point within the engine coolant loop. Regardless of where the coolant is reintroduced to the engine coolant loop, the coolant fluid is ultimately drawn into the engine whereupon the cycle is repeated.

The primary purpose of the commingling chamber is to provide a common juncture in which the coolant fluid can be shared by both the engine cooling loop and the nitrogen water bath vaporizer loop. The commingling chamber also provides a means to accommodate differing flow rates within these two flow loops. For instance, if the flow rate generated by the engine pump is different than the flow rate generated by the auxiliary converter pump, the two systems would suffer from fluid flow imbalance, and pump impeller cavitation and poor coolant circulation and possibly failures within one or both loops would result. A commingling chamber may also serve as an expansion chamber to allow for the thermal expansion of the coolant as it is subjected to heat. Alternatively, the commingling chamber can also serve as a juncture to a remote expansion chamber if so desired.

The above described system is somewhat simplified and in practice additional cooling loops and components are often used, but the overall scheme is exemplary of flameless type nitrogen converter units and particularly those available from the assignee of the present invention.

An exemplary prior art commingling chamber is shown in FIG. 1 of the drawings. Prior art commingling chamber 2 has a generally cylindrically-shaped vessel defined by wall 4 which is typically provided with an inlet port 6 for introducing heated coolant fluid from the engine, an outlet port 8 for directing commingled fluid to a nitrogen vaporizer, an inlet port 10 for reintroducing coolant fluid from a water bath nitrogen vaporizer (not shown in FIG. 1), and an outlet port 12 for redirecting commingled fluid to the engine. Top portion 14 of vessel 2 can be used as a coolant expansion chamber to allow for thermal expansion of the coolant if desired, and internal flow baffling 16 and 18 serve to enhance mixing of the fluid as it travels through chamber 2.

Because a coolant commingling chamber is an essential component in providing consistent and reliable operational characteristics of the engine and vaporizer coolant loops, there remains a long standing need to improve the design of such chambers without jeopardizing the ability of the commingling chamber to compensate for unequal flow rates between coolant loops sharing the same thermodynamic working fluid.

One reason for the need to improve the operating efficiencies of such commingling chambers is because there is an ever present need to reduce the overall size, weight, and footprint of equipment that is to be placed on offshore wells.

There is a similar long standing need to increase efficiencies for units placed on trucks and trailers as there are numerous size, gross weight, and load restrictions placed on such vehicles as well.

Furthermore, increasing efficiencies of such commingling chambers will allow for increased capacity of units without the need to bear associated costs attributable to an increase in engine size or nitrogen vaporizer size or other cost raising factors.

SUMMARY

An improved commingling chamber for the distribution and pressure equalization of a thermodynamic working fluid used in a recirculating liquid type heat transfer processing system is disclosed. The improved commingling chamber includes a primary volumetric chamber generally defined by a vessel wall, a top portion of the chamber, a lower portion of the chamber having a side wall. The lower portion terminates into a base preferably having an outlet port located therein. At least one inlet port and outlet port are located in the vessel wall. A conduit having a first end attached to at least one inlet port and being of sufficient length and configuration to vector incoming fluid toward the base outlet port, and a flow through region between a terminating end of the conduit means is provided to form a flow path between fluid exiting the conduit and the volumetric chamber.

Also disclosed is an improved commingling chamber for the distribution and pressure equalization of a thermodynamic working fluid used in a recirculating liquid type heat transfer processing system wherein the commingling chamber comprises a primary volumetric chamber generally defined by a vessel wall, a top portion of the chamber, a lower portion of the chamber, the lower portion terminating into a base having a first outlet port located therein and being in fluid communication with the volumetric chamber. A first inlet port located in the vessel wall and being in fluid communication with the volumetric chamber is provided as well as the provision of a second and a third outlet port located in the vessel wall and being in fluid communication with the volumetric chamber. A second and a third inlet port located in the vessel wall at preselected positions below the first and second inlet ports and above the first outlet port and further provided and conduit means having an end attached to the second and third inlet ports and being of sufficient length and configuration to vector incoming fluid toward the first outlet port. Lastly a flow through region between a terminating end of the conduit means is provided to form a flow path between fluid exiting the conduit means and the volumetric chamber.

Lastly, a recirculative liquid type heat transfer processing system for converting a liquid wherein a commingling chamber for the distribution and pressure equalization of a shared thermodynamic working fluid is used therein is disclosed. The system comprises at least one heat source in which the working fluid gains heat energy, means for introducing the working fluid into the commingling chamber, at least one vaporizing unit wherein the working fluid transfers heat to the liquid to be converted, means for directing a significant portion of the working fluid introduced into the commingling chamber toward an outlet means provided in the commingling chamber which ultimately leads to the at least one vaporizing unit, such directing means minimizing the amount of exposure to cooler fluid currently resident within the commingling chamber, means for returning the working fluid into the commingling chamber, means for returning the working fluid to the heat source, and means within the commingling chamber for allowing pressure equalization between the working fluid passing through the at least one heat source and the at least one vaporizing unit.

BRIEF DESCRIPTION OF THE DRAWINGS

FIG. 6 is an exemplary coolant flow schematic of a nitrogen processing unit having the embodiment of the improved commingling chamber shown in FIGS. 5A and 5B.

DETAILED DESCRIPTION

Figure 2A:
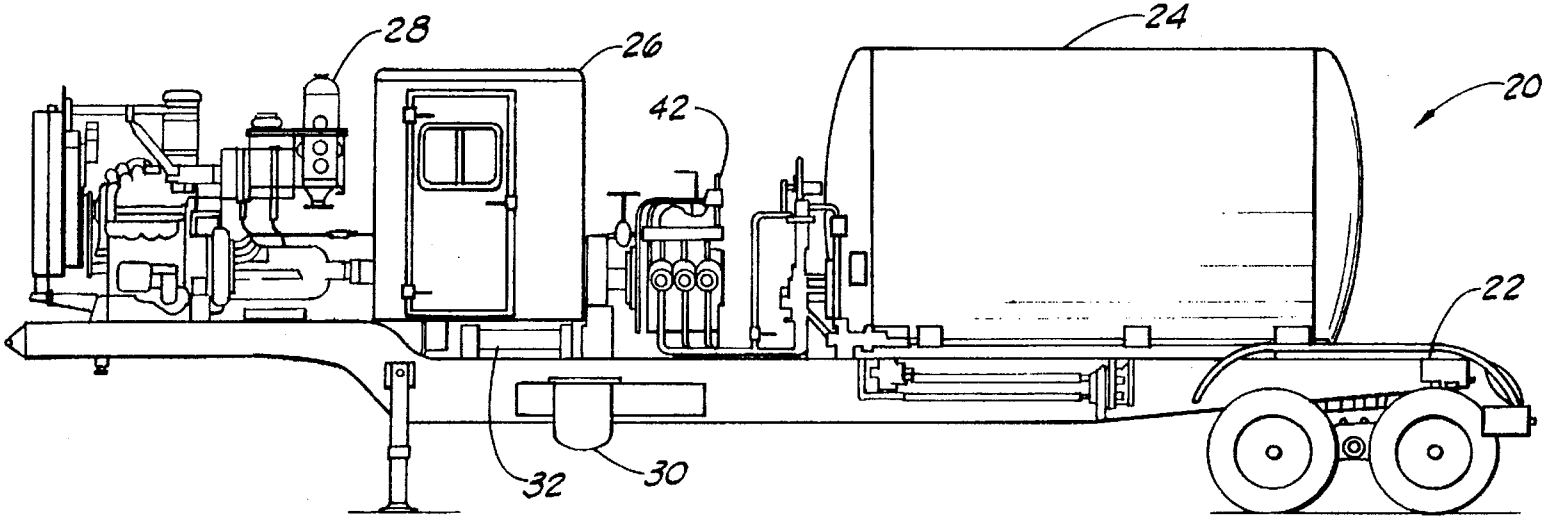
FIG. 2A is a side view of a representative nitrogen processing unit mounted on a tractor trailer having an improved commingling chamber installed thereon.
Figure 2B:
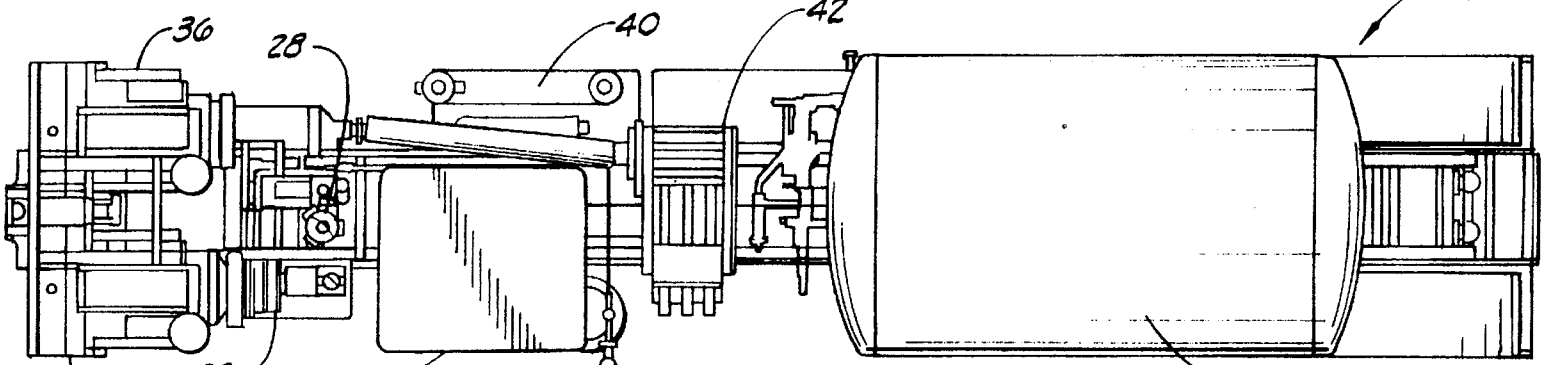
FIG. 2B is a top view of the unit shown in FIG. 2A.

Referring now to FIGS. 2A and 2B of the drawings. A representative nitrogen processing unit 20 as mounted on a tractor trailer is shown in a side view and a top view respectively. As seen in FIG. 2A, a trailer chassis 22 provides a base for the mounting of a liquid nitrogen tank 24, an operator control house 26, an embodiment of the present invention of a coolant commingling chamber 28, a liquid, or water bath vaporizer 30, and a hydraulic fluid heat exchanger 32. As seen in FIG. 2B, the top view additionally shows a heat engine 34, a pump engine 36, hydraulic pumps 38, a transmission fluid heat exchanger 40, and a nitrogen pump 42. The identified components are exemplary of the major components of what would be found on a flameless type nitrogen processing unit. Primarily FIGS. 2A and 2B serve to provide a visual reference for better understanding the positioning of a commingling chamber with respect to the general layout of a known nitrogen processing unit, synonomously referred to as a nitrogen converter unit.

Figure 1:
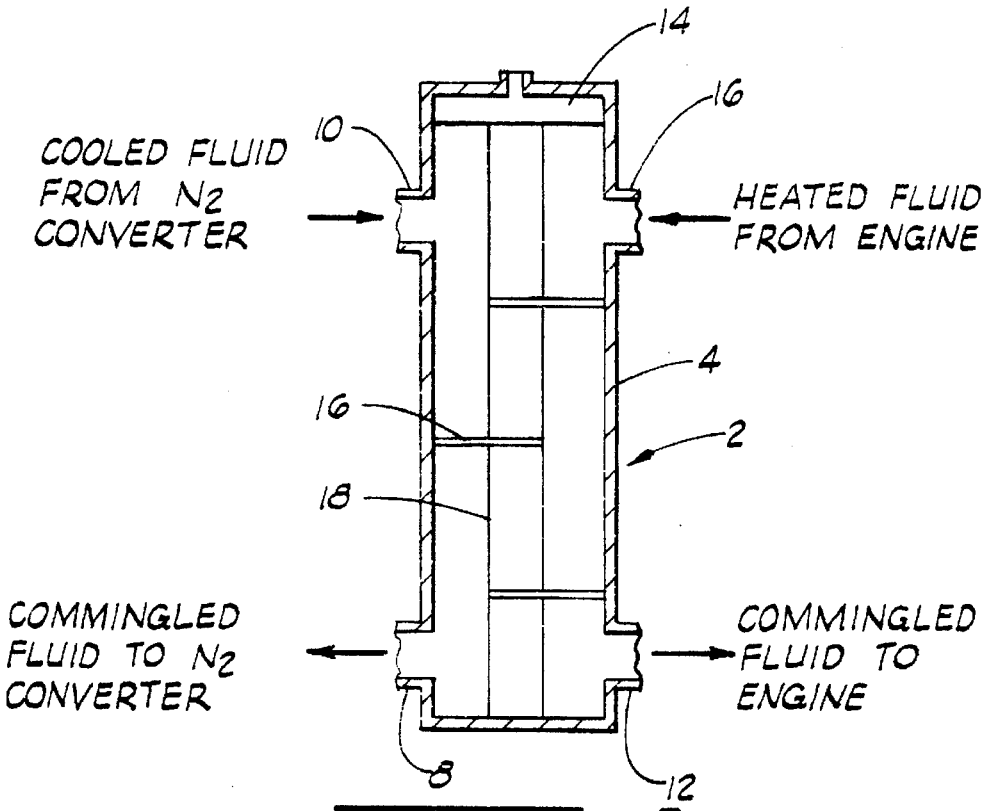
FIG. 1 PRIOR ART
FIG. 1 is a cross-sectional view of a representative prior art commingling chamber for use in connection with a nitrogen processing unit.
Figure 3A:
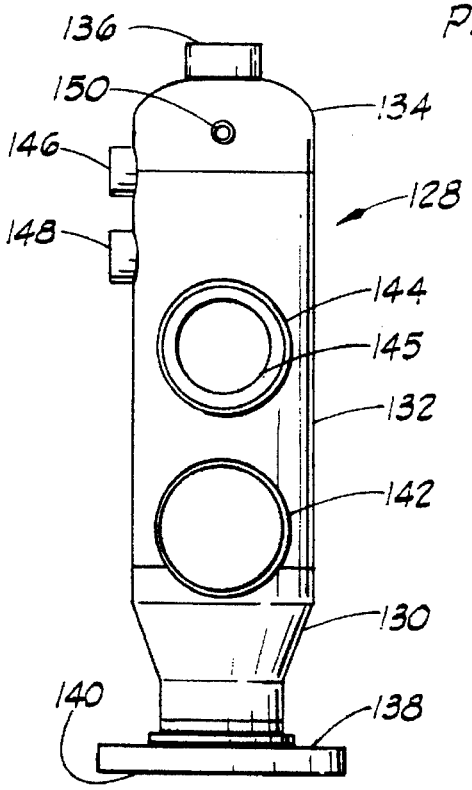
FIG. 3A is a side view of an embodiment of an improved commingling chamber having a single inlet port for incoming engine-coolant.
Figure 3B:
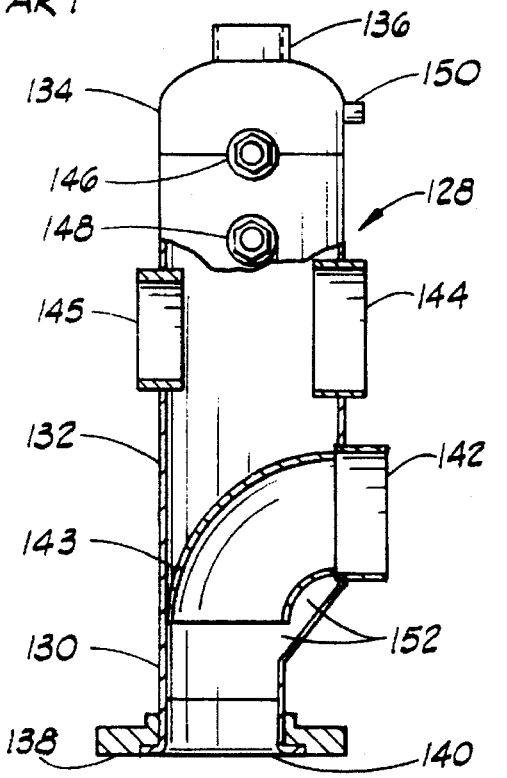
FIG. 3B is a partially broken away front view of the commingling chamber shown in FIG. 3A.

Referring now to FIGS. 3A and 3B of the drawings. A side view and a partially broken away front view of an embodiment of the present invention of coolant commingling chamber 128 are shown respectively. Commingling chamber 128 is preferably of a liquid tight welded steel construction that is able to easily withstand operating pressures of at least one atmosphere gauge such as would be produced by pumps installed on diesel fueled internal combustion engines and by auxiliary centrifugal/impeller type pumps. However, other materials and construction techniques could be used to meet differing operating temperatures, pressures, flow rates and coolant compatibility. Chamber 128 is generally defined by a cylindrically-shaped vessel wall 132 preferably having a partially tapered lower vessel wall portion 130 forming a lower end and a preferably domed upper end vessel portion 134 having a vent receptacle 136 on top thereof. Lower portion 130 terminates onto a base 138 having a vaporizer outlet port 140 in communication with the chamber to provide a path for coolant to be drawn toward a vaporizer, synonomously referred to as a water bath vaporizing unit, which is typically installed within a converter unit. Inlet port 142 in passing through vessel wall 130 provides a path in which coolant from an engine is introduced into chamber 128. Outlet port 144 provides a return path to the radiator of the engine. Inlet port 145, shown as being in line with outlet port 144 and oppositely mounted thereof on vessel wall 132, as can be better seen in FIG. 3B provides a port in which coolant from the vaporizer is returned into commingling chamber 128. An air vent port 150 is preferably provided on the side of domed top 134. Relatively smaller ports 146 and 148 serve as fittings for installation of a fluid level sight gauge, or for installation of flow lines leading to and from a remote expansion tank or other accessories related to monitoring or regulating coolant level within the chamber. The ports are thus typically threaded to accommodate standard pipe fittings.

Of particular importance is the provision of an elbow 143 that directs heated coolant from the engine into outlet port 140 where the fluid is ultimately routed through the nitrogen vaporizer. By so directing the flow of the coolant into bottom portion of the vessel, the heated coolant looses very little of its heat energy to the relatively cooler surrounding coolant and thereby increases the overall efficiency of the nitrogen processing unit. This enables greater vaporization/conversion capacity from a given size of engine being used for its heat generation in comparison to converter units employing prior art commingling chambers. Furthermore, providing a flow through region 152 between elbow 143 and vessel walls 130 and 132 allows communication between the lowermost portion of chamber 128 and the main region of chamber 128, allows the commingling chamber to compensate for the flow rates of the engine coolant loop and the vaporizing coolant loop without unduly reducing the efficiency gained by directing the flow of the heated engine coolant as just described. Chamber 128 depicted in FIGS. 3A and 3B is specifically designed for processing units that are to have a single engine coolant inlet and a single engine coolant return port. That is heated coolant from a given heat generating source, such as a diesel engine, is introduced into chamber 128 via a single port such as 142 and is returned to the engine via a single port such as 144.

Figure 4A:
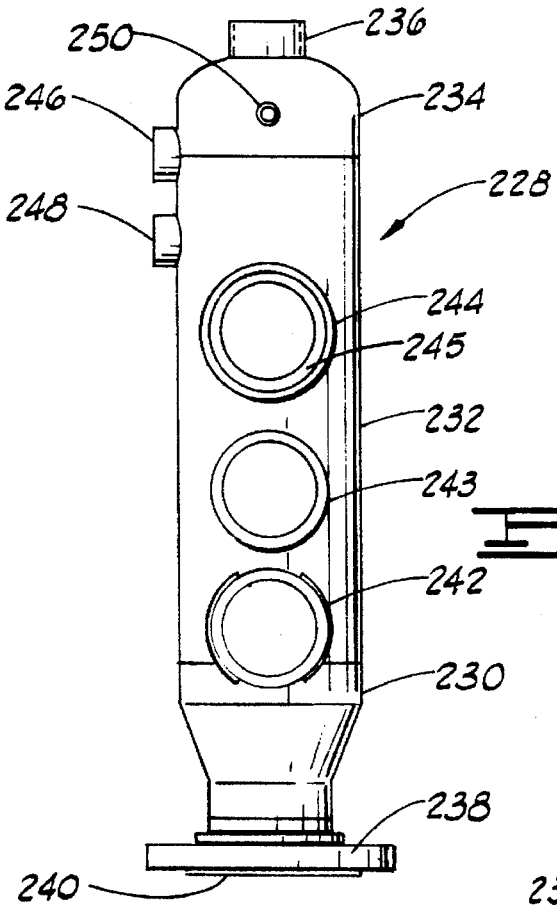
FIG. 4A is a side view of an embodiment of an improved commingling chamber having dual inlet ports for incoming engine coolant.
Figure 4B:
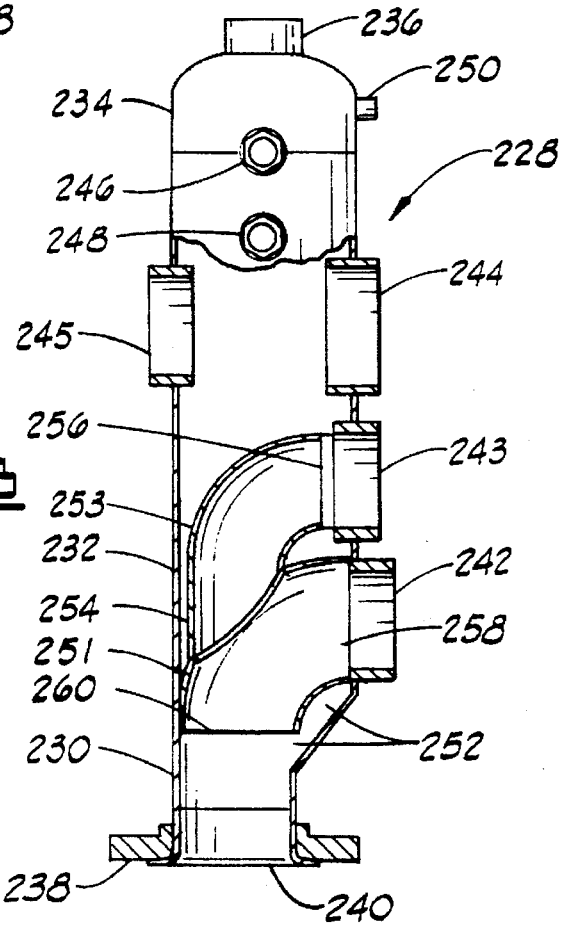
FIG. 4B is a partially broken away front view of the commingling chamber shown in FIG. 4A.

Referring now to FIGS. 4A and 4B which depict an embodiment of the present invention suitable for use with two feed lines for introducing heated coolant from at least one heat source such as a diesel fueled engine to provide the heat needed by a nitrogen converter unit. Commingling chamber 228 is provided with a lower portion 230 having a sidewall 232 and a preferably domed top portion 234 having a vent 236 atop thereof. Preferably lower portion 230 tapers downwardly toward and is connected to a base 238 having an outlet port 240 for directing coolant to a nitrogen vaporizer. A lower coolant inlet port for introducing coolant from an engine into chamber 228 is provided proximate to lower portion 230. A second or upper coolant inlet port for introducing coolant from the heat source, or sources, is provided proximate to and above lower portion 230. Such an arrangement thereby enables one commingling chamber to be used with two coolant input sources, or with two heat generating sources, such as two diesel fueled engines to provide the heat energy needed to operate larger capacity vaporizers. As can best be seen in FIG. 4B, ports 242 and 243 are connected to first portion 256 of upper elbow 253 and first portion 258 of lower elbow 251. Lower portion 254 of upper elbow 253 is fabricated to be fitted to the outer bend of elbow 251 for directing coolant stream within elbow 253 into the coolant stream within elbow 251. Lower portion 260 of lower elbow 251 thereby directs the now combined coolant flow streams through port 240 whereupon the coolant is eventually routed to a nitrogen vaporizer. Lower elbow 251 preferably has an increased I.D., in order to accommodate the increased flow rate attributable to combining the coolant streams flowing through both elbows.

As with commingling chamber 128, commingling chamber 228 has a conceptually similar flow through region 252 to prevent an undesired imbalance within the coolant flow loops due to there likely being different flow rates through the engine coolant loops and the vaporizer heat exchanger coolant loop. In the embodiment shown in FIGS. 4A and 4B, the flow through region is designed to be around elbow 251 and between the lower and somewhat tapered portion 230. As with commingling chamber 128, the exact location of flow through region 252 is not necessarily critical provided that there is a region in fluid communication with the lower most portion of the elbow directing coolant from the engine into vaporizer outlet port 240 and into the main area of commingling chamber 228 and that the warmer-most coolant is vectored, or directed, so as to spend as little amount of resident time as feasible in the commingling chamber to prevent unnecessarily mixing with cooler coolant and thereby losing heat energy prior to being circulated within the vaporizer.

Additionally, as with commingling chamber 128, commingling chamber 228 provides enhanced efficiency over prior art chambers, by providing for the usually now relatively high temperature coolant stream from the engine to be efficiently directed toward outlet port 240 to reduce the unwanted introduction of heat from the heated coolant to the main body of the commingling chamber in contrast to prior art. Thus, the overall efficiency of the vaporizing unit and in turn the overall efficiency of the entire nitrogen processing unit in which commingling chamber 228 is installed, is significantly increased.

Outlet port 244 leads to the radiators of the heat source engines and is of such size to appropriately accommodate the flow rate of the coolant being returned to the engine. Vaporizer inlet port 245 provides for the reintroduction of coolant from the vaporizer to the commingling chamber. It too is sized to appropriately accommodate the flow rate of the coolant being returned to the engines. Ports 246, 248, and 250 are provided to fulfill the same functions as described in connection with the embodiment shown in FIGS. 3A and 3B and labeled 146, 148, and 250 respectively.

Commingling chamber 228 is preferably a welded steel structure being designed to withstand exposure to predicted operating parameters such as pressures, temperatures, flow rates, and coolant compatibility. However, other suitable materials and methods of construction can be used to meet these and other operating parameters.

Referring now to FIGS. 5A–5D illustrating a commingling chamber 328 embodying the subject invention. Commingling chamber 328 is designed to accommodate the introduction and return of coolant generated from at least two sources such as two diesel fueled engines. Commingling chamber 328 has a vessel wall 332 forming a generally cylindrically-shaped vessel defining the main portion of chamber 328. Engine coolant outlet ports 341 and 344 located about the main region of the chamber in approximately the same horizontal plane and are positioned approximately 90 degrees from each other as viewed in the top view of FIG. 5C. A coolant return port 345 is provided in approximately the same horizontal plane as outlet ports 341 and 344 and is positioned approximately 135 degrees form outlet port 344 as shown in top view FIG. 5C. Such an arrangement provides for a more direct route for the relatively cool coolant returning from the nitrogen vaporizer to make its eventual return to the heat sources and serves to further increase the operating efficiency of the commingling chamber and the overall efficiency of the converter unit in which it is installed. Typically ports 341 and 344 have flanges and hoses attached to each in order to return coolant to respective radiators of the heat generating engines.

Ports 346, 347, 348, and 349 are for the installation of coolant level sight gauges or remote expansion tanks, or both and are typically threaded to accommodate standard pipe fittings that can accommodate flexible coolant lines. Ports 350 and vent 336 in upper dome portion 334 serve the same respective function as ports 250 and 150, and vents 136 and 236 previously discussed.

Figure 5A:
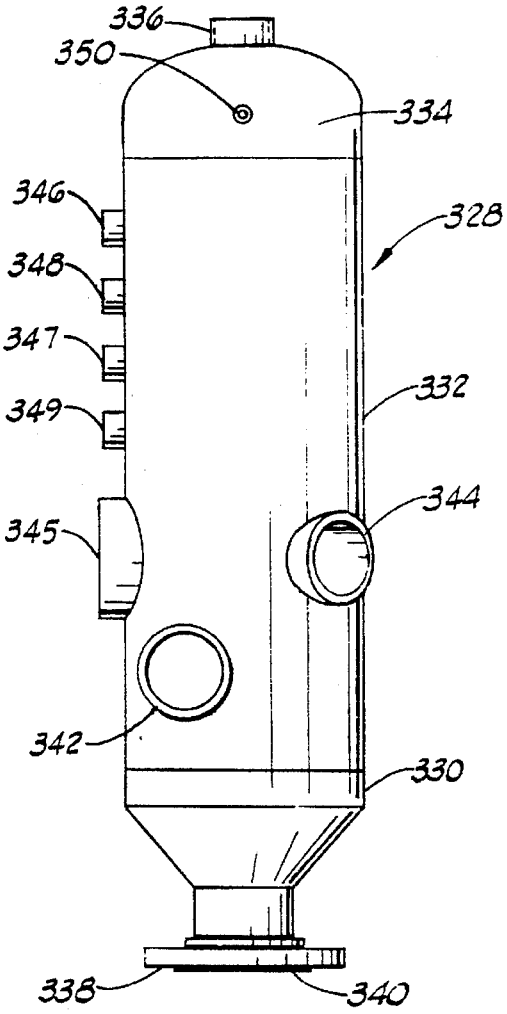
FIG. 5A is a side view of an embodiment of an improved commingling chamber having dual inlet ports for incoming engine-coolant and dual engine-coolant outlet ports for outgoing coolant.
Figure 5B:
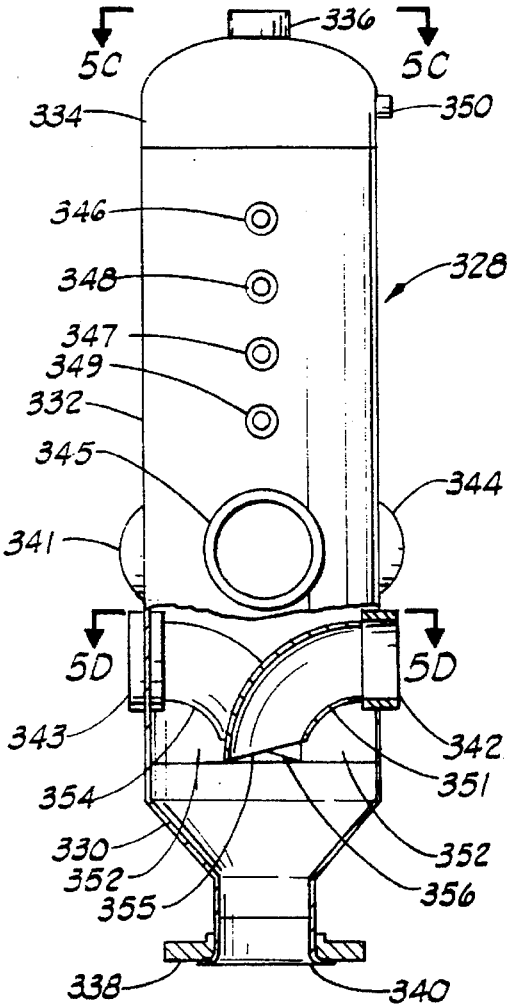
FIG. 5B is a partially broken away front view of the commingling chamber shown in FIG. 5A.
Figure 5C:
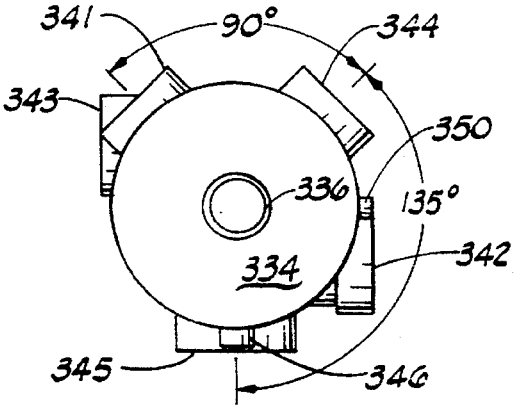
FIG. 5C is a top view taken along section 5C—5C as shown in FIG. 5B.
Figure 5D:
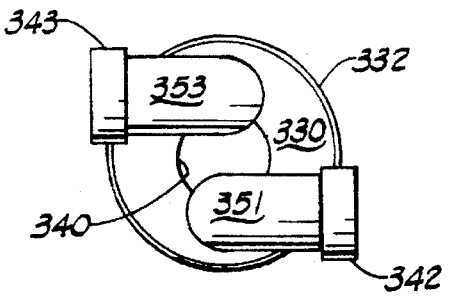
FIG. 5D is a top view taken along section 5D—5D as shown in FIG. 5B.

Engine coolant inlet ports 342 and 343 are preferably located in the same horizontal plane and are located below ports 341, 344, and 345 in vessel wall 332. Inlet ports 342 and 343 are offset and oppositely positioned from each other as viewed in FIGS. 5B, 5C, and 5D. Furthermore, inlet ports 342 and 343 are fitted with generally downwardly directed internal elbows 351 and 353 respectively. Elbows 351 and 353 thus lay in a parallel relationship and preferably extend to generally the center of the commingling chamber proximate to lower conically shaped portion 230. Free ends 355 and 356 of elbows 351 and 354 further terminate approximately about the center vertical axis of the commingling chamber and conical portion, disregarding the offset between elbows 351 and 354 to allow clearance between the two, to provide a flow through region 352 between elbows 351 and 354, between vessel wall 332 of the main body, and the inside of generally conical lower portion 330. Elbow free ends 355 and 356 are preferably slightly angled as shown in FIG. 5B to enhance the coolant flow out of the elbow by inducing a swirling effect to the coolant as it makes its way toward the bottom most region of commingling chamber 330. Furthermore, the angled elbow ends serve to help air bubbles escape from the coolant flowing through the elbows enabling the air bubbles to rise to the upper portion of the commingling chamber whereupon the bubbles can be vented. Although separate elbows on coolant inlet ports have been shown in FIGS. 5B and 5D, a single elbow or conduit could be used if desired, or two elbows or conduits could be joined together in a similar manner shown in FIG. 4B.

Base 338 is attached to lower vessel wall portion 320. Base 338 which has an outlet port 340 essentially directly below elbow ends 355 and 356 for efficiently leading coolant to a vaporizing unit mounted on the nitrogen processing unit in which commingling chamber 328 is to be installed provides a convenient base for mounting commingling chamber 328 onto a skid, trailer, or truck as desired. Of course any of the commingling chambers discussed herein may be supported by alternative mounting methods, such as mounting ears, flanges, or straps about the main body, etc. as required by space and design limitations of the installation site.

Figure 5:
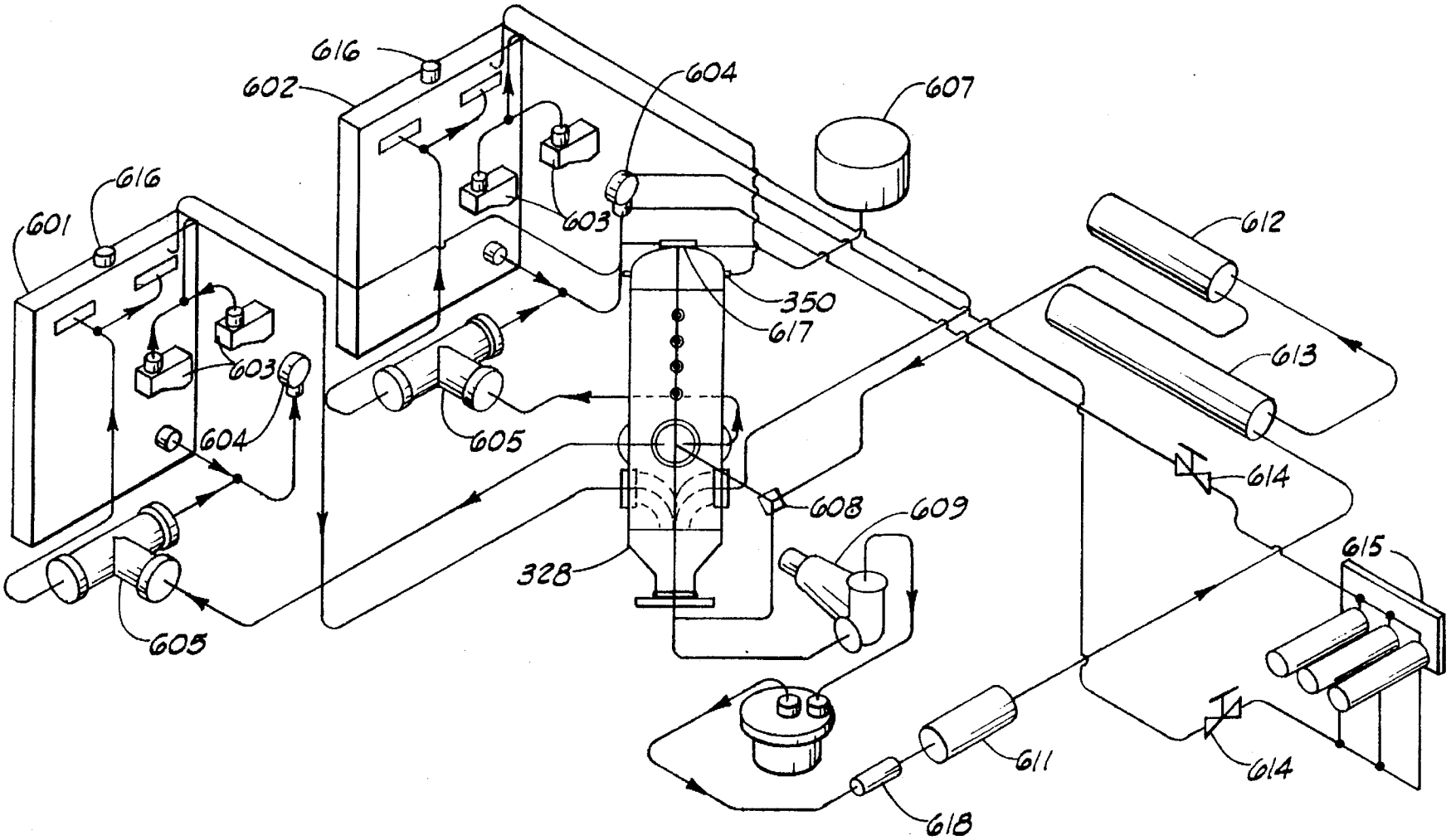

Referring now to FIG. 6 of the drawings which depicts a representative coolant flow schematic of a nitrogen processing unit mounted on a tractor trailer having two diesel fueled engines serving as heat sources for the vaporization of liquid nitrogen and wherein the commingling chamber of FIG. 5 is incorporated.

A first engine radiator 601 and a second engine radiator 602 each having a filler neck 616 are shown. Coolant is drawn into engines from the lower portion of radiators 601 and 602 by engine driven pumps 604. Engine thermostatic coolant outlet valves 603 generally serve as the outlet point for coolant that has become heated upon being circulated within the cooling jackets of the engines (not shown). Heated coolant is then routed to respective inlet ports of commingling chamber 606 whereupon the coolant is primarily directed out the bottom thereof and on to an auxiliary coolant pump 609. After the still heated coolant has passed through pump 609, it is routed to nitrogen vaporizing bath unit 610. The now cooler coolant is then routed through hydraulic component case heat exchanger 618 and lubrication oil heat exchanger 611 and onto hydraulic oil heat exchanger 613 and transmission oil heat exchanger 612. After leaving heat exchanger 612, the coolant is routed through a bypass valve 608 where the coolant is either bypassed around commingling chamber 328 or returned to commingling chamber 606 via the vaporizing inlet port. Upon the coolant being reintroduced into chamber 328, the coolant is eventually returned to the radiators via the engine radiator outlet ports of commingling chamber 328. The temperature of the fluid end of nitrogen pump 615 is modulated by a coolant loop running from engine coolant pump 604 and isolation valves 614 can be used to isolate nitrogen pump 615 from the circulation of coolant. A remote vented surge tank 607 is provided with a coolant line running to the top portion of commingling chamber 328 near vented pressure cap 617. Likewise a coolant line is run from air vent ports 350 of commingling chamber 328 to the tops of radiators 601 and 602.

As mentioned earlier the schematic of FIG. 6 is merely representative of the coolant flow paths and various components that can be found on nitrogen converter units in which the subject improved commingling chamber is particularly suitable for installation and use thereon.

It will be understood by those skilled in the art that modifications to the invention of an improved commingling chamber as claimed may be made without departing from the spirit and scope of the disclosed invention.

What is claimed is:

1. An improved commingling chamber for the distribution and pressure equalization of a thermodynamic working fluid used in a recirculating liquid type heat transfer processing system wherein the commingling chamber comprises:

a) a volumetric chamber generally defined by a vessel wall;

b) a top portion of the chamber;

c) a lower portion of the chamber having a side wall, the lower portion terminating into a base;

d) a first outlet port located in a preselected position of the chamber and being in fluid communication with the volumetric chamber;

e) a first inlet port located in the vessel wall and being in fluid communication with the volumetric chamber;

f) a second outlet port located in the vessel wall and being in fluid communication with the volumetric chamber;

g) a second inlet port located in the vessel wall at a preselected position below the first inlet port and above the first outlet port;

h) a conduit means having a first end attached to the second inlet port being of sufficient length and configuration to vector incoming fluid toward the first outlet port; and i) a flow through region between a terminating end of the conduit means to provide a flow path between fluid exiting the conduit means and the volumetric chamber.

2. The improved commingling chamber of claim 1 further comprising:

a) the top portion of the chamber having a dome shaped top having a pressure vent means;

b) the chamber having at least two port fitting means for accommodating suitable fluid level related accessories; and c) the first outlet port being located in the base of the chamber.

3. The commingling chamber of claim 1 wherein the first inlet port and the second outlet port are positioned approximately in the same horizontal plane and approximately opposite each other.

4. The commingling chamber of claim 1 wherein the second inlet port is located below the first inlet port and the second outlet port and wherein the conduit means comprises an elbow having approximately a 90 degree turn.

5. The commingling chamber of claim 1 wherein at least a portion of the sidewall of the lower portion of the commingling chamber slopes toward the center of the first outlet port.

6. The commingling chamber of claim 1 wherein the top portion has an air vent port for the fitting of an air vent line therefrom and the commingling chamber is provided with at least one port fitting means for installation of fluid level related accessories.

7. The commingling chamber of claim 1 further comprising:

a) a third inlet port; and b) a second conduit means having a first end attached to the third inlet port and a second end joined to the first conduit means to introduce fluid flowing through the second conduit means with fluid flowing through the first conduit means.

8. The commingling chamber of claim 7 wherein:

a) the third inlet port is positioned above the second inlet port and below the second outlet port;

b) the first and second conduit means each have a bend of approximately 90 degrees and each conduit means each have a nominal diameter;

c) the first conduit means nominal diameter is greater than the nominal diameter of the second conduit means nominal diameter; and d) the second end of the second conduit means joins the first conduit means so as to share a common centerline extending vertically from the approximate center of the first outlet port.

9. The commingling chamber of claim 1 generally being fabricated of a material suitable for containing a pressurized thermodynamic working fluid comprising an anti-freezing constituent.

10. The commingling chamber of claim 1 being installed in a nitrogen processing unit wherein liquid nitrogen is vaporized by the transfer of heat energy obtained from a thermodynamic working fluid that has been exposed to at least one heat source.

11. An improved commingling chamber for the distribution and pressure equalization of a thermodynamic working fluid used in a recirculating liquid type heat transfer processing system wherein the commingling chamber comprises:

a) a volumetric chamber generally defined by a vessel wall;

b) a top portion of the chamber;

c) a lower portion having a side wall attached to the chamber in a fluid tight manner, the lower portion terminating into a base having a first outlet port located therein and being in fluid communication with the volumetric chamber;

d) a first inlet port located in the vessel wall and being in fluid communication with the volumetric chamber;

e) a second and a third outlet port located in the vessel wall and being in fluid communication with the volumetric chamber;

f) a second and a third inlet port located in the vessel wall at preselected positions below the first and second inlet ports and above the first outlet port;

g) conduit means having an end attached to the second and third inlet ports and being of sufficient length and configuration to vector incoming fluid toward the first outlet port; and h) a flow through region between a terminating end of the conduit means to provide a flow path between fluid exiting the conduit means and the volumetric chamber.

12. The commingling chamber of claim 11 comprising:

a) the conduit means comprising individual elbows originating from the second and third inlet ports and each elbow having a bend of approximately 90 degrees and terminating in a side-by-side relationship above the first outlet port.

13. The commingling chamber of claim 12 wherein at least one elbow is terminated at an angle with respect to a horizontal axis of the commingling chamber.

14. The commingling chamber of claim 11 wherein the first inlet port and the second and third outlet ports are positioned approximately in the same horizontal plane and the second and third outlet ports are located approximately 90 degrees from each other and the first inlet port is located approximately symmetrically opposite second and third outlet ports.

15. The commingling chamber of claim 11 wherein at least a portion of the sidewall of the lower portion of the commingling chamber slopes toward the center of the first outlet port.

16. The commingling chamber of claim 11 wherein the top portion has an air vent port for the fitting of an air vent line therefrom and the commingling chamber is provided with at least one port fitting means for installation of fluid level related accessories.

17. A recirculative liquid type heat transfer processing system for vaporizing a liquid wherein a commingling chamber for the distribution and pressure equalization of a shared thermodynamic working fluid is used therein, the system comprising:

a) at least one heat source in which the working fluid gains heat energy;

b) means for introducing the working fluid into the commingling chamber;

c) at least one vaporizing unit wherein the working fluid transfers heat to the liquid to be vaporized;

d) means for directing a significant portion of the working fluid introduced into the commingling chamber toward an outlet means provided in the commingling chamber which ultimately leads to the at least one vaporizing unit, such directing means minimizing the amount of exposure to cooler fluid currently resident within the commingling chamber;

e) means for returning the working fluid into the commingling chamber;

f) means for returning the working fluid to the heat source; and f) means within the commingling chamber for allowing pressure equalization between the working fluid passing through the at least one heat source and the at least one vaporizing unit.

18. The processing system of claim 17 wherein the means for directing the working fluid toward the outlet means leading to the vaporizing unit comprises at least one conduit of a predetermined size and geometry.

19. The processing system of claim 18 wherein the means for directing the working fluid toward the outlet means is joined with another means for directing the working fluid toward the outlet means.

20. The processing system of claim 17 wherein the commingling chamber has means for accommodating working fluid level related accessories and is able to accommodate the introduction and return of working fluid from and to a plurality of heat sources.

* * * * *